United States Patent [19]

Sartor

[11] Patent Number: 4,620,378

[45] Date of Patent: Nov. 4, 1986

[54] SKI BOOT INCORPORATING A FOOT SECURING DEVICE

[75] Inventor: Mariano Sartor, Montebelluna, Italy

[73] Assignee: Nordica S.p.A., Montebelluna, Italy

[21] Appl. No.: 737,001

[22] Filed: May 23, 1985

[30] Foreign Application Priority Data

May 30, 1984 [IT] Italy ..... 21967/84[U]

[51] Int. Cl.[4] ..... A43B 5/04

[52] U.S. Cl. ..... 36/119; 36/58.5

[58] Field of Search ..... 36/117–121, 36/50, 58.5, 105; 24/68 SK

[56] References Cited

U.S. PATENT DOCUMENTS 4,160,332 7/1979 Salomon ..... 36/119

4,513,520 4/1985 Koch ..... 36/119

FOREIGN PATENT DOCUMENTS 0099504 2/1984 European Pat. Off. ..... 36/117

0132744 2/1985 European Pat. Off. ..... 36/117

6557 of 1897 United Kingdom ..... 36/58.5

*Primary Examiner*—James Kee Chi

*Attorney, Agent, or Firm*—Guido Modiano; Albert Josif

[57] ABSTRACT

The ski boot incorporating a foot securing device comprises a shell wherein a foot instep presser is accommodated. A small cable is attached with one of its ends to a cable tensioning element actuatable the exterior of said ski boot. The cable extends over the foot instep presser and rearwardly encloses the heel region of the user's foot, the cable being connected with the other of its ends to a fixed point on said ski boot.

7 Claims, 2 Drawing Figures

SKI BOOT INCORPORATING A FOOT SECURING DEVICE

BACKGROUND OF THE INVENTION

This invention relates to a ski boot incorporating a foot securing device.

An earlier patent application by the same Assignee (U.S. application Ser. No. 06/510,748, filed on July 5, 1983), which is incorporated herein for reference, discloses a ski boot having a foot securing device which comprises essentially a small cable attached with one end to a take-up reel provided on the ski boot exterior and extending above the the foot instep presser. The cable is attached, with its other end, to the boot interior at a side location.

With the above prior device, on winding the cable around the reel, the presser is gradually lowered onto the foot instep until it exerts a desired amount of pressure to secure the foot within the boot.

That approach, while being in many ways satisfactory, can still be improved as regards firm securement of the foot with respect to the presser.

SUMMARY OF THE INVENTION

It is the aim of this invention, in fact, to provide a ski boot incorporating a securing device which can firmly and simultaneously secure the foot both at the instep and heel regions thereof, thereby affording reliable and stable locating of the foot within the ski boot.

Within the above aim, a particular object of this invention is to provide a ski boot wherein the foot securing device, while being active on more spaced apart regions of the foot, can be operated through a single element which may be positioned at any location on the boot which is accessible from the outside.

Another object of this invention is to provide a ski boot whereby the foot can be secured with a distributed pressure action, to avoid localized, concentrated stresses which are apt to be inconvenient for the user and significantly improve safety in the practice of skiing.

A further object of this invention is to provide a ski boot incorporating sa securing device, which is of simplified construction and competitive from a purely economical standpoint.

The above aim, as well as these and other objects to become apparent hereinafter, are achieved by a ski boot incorporating a foot securing device, according to the invention, comprising a shell wherein a foot instep presser is accommodated, characterized in that it comprises a small cable attached with one of its ends to a cable tensioning element actuatable from the exterior of said ski boot, said cable extending over said foot instep presser and enclosing rearwardly the heel region of the user's foot, and being connected with the other of its ends to a fixed point on said ski boot.

BRIEF DESCRIPTION OF THE DRAWINGS

Further features and advantages will be more clearly apparent from the following detailed description of a ski boot incorporating a foot securing device, as shown by way of illustration and not of limitation in the accompanying drawing, where.

DESCRIPTION OF THE PREFERRED EMBODIMENTS

Figure 1:
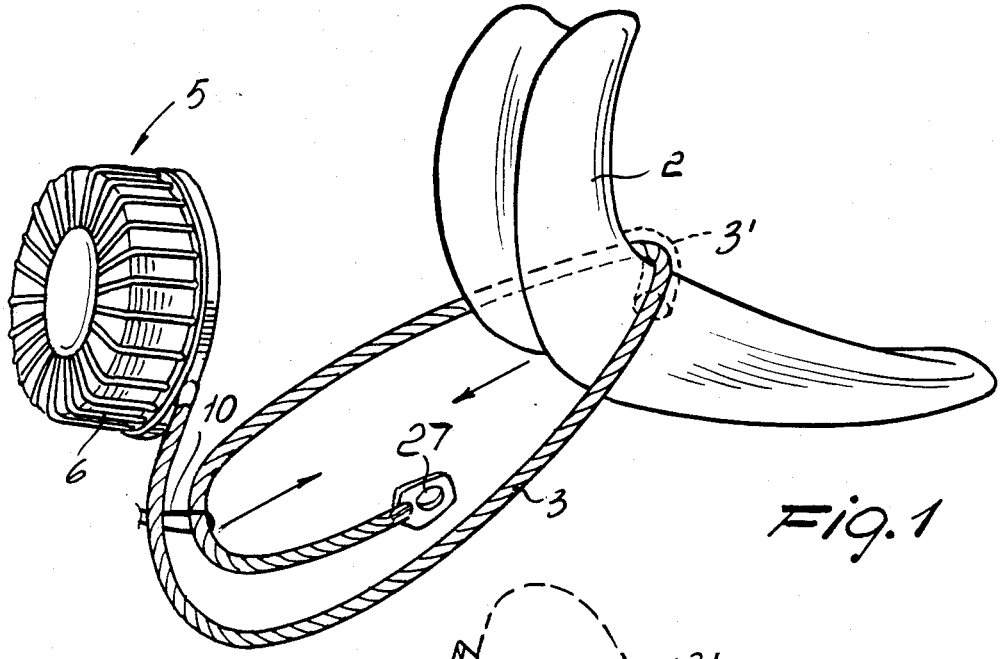
FIG. 1 shows diagrammatically this securing device.

With reference to the drawing figures, a ski boot incorporating a foot securing device, according to the invention, which is generally designated with the reference numeral 1, comprises on the interior of its shell a foot instep pressure 2 inwardly below the instep portion 20*a* of the shell 20. The presser 2, as is usual, would be formed from a substantially rigid material and have a mainly arcuated configuration so that the shape of its bottom face matches that of the foot region whereon it will be acting, i.e. the foot instep.

The presser 2 is located inside the shell 20 and, in general, outside of the traditional soft inner shoe 21 that fits inside the ski boot 1. Instead of an inner shoe or boot, soft liner portions or partial inner bott portions may be used.

The securing device includes a small cable length of first intermediate section 31 of the cable, indicated at 3, which extends, possibly through some flexible sheathing 3' indicated in dotted lines, over the presser element 2, across the longitudinal direction thereof.

The cable 3 is connected, with one of its ends, to a tensioning element which may be a take-up reel, such as the one illustrated in U.S. Pat. No. 4,433,456 of the same Applicant, which is mounted on the exterior of the boot 1. As shown in the drawing, the reel 5 is located rearwardly near the heel portion 20*b* of the shell, but it is envisaged that it may be located elsewhere on the boot.

The reel 5 is provided with a knurled knob 6 which enables the reel to be rotated to take up the cable with an accurate locked position feature due to the provision of special ratchet mechanisms as described in the cited U.S. patent application.

The cable take-up device used herein affords quick release features when the pressure applied by the pressure element.

Figure 2:
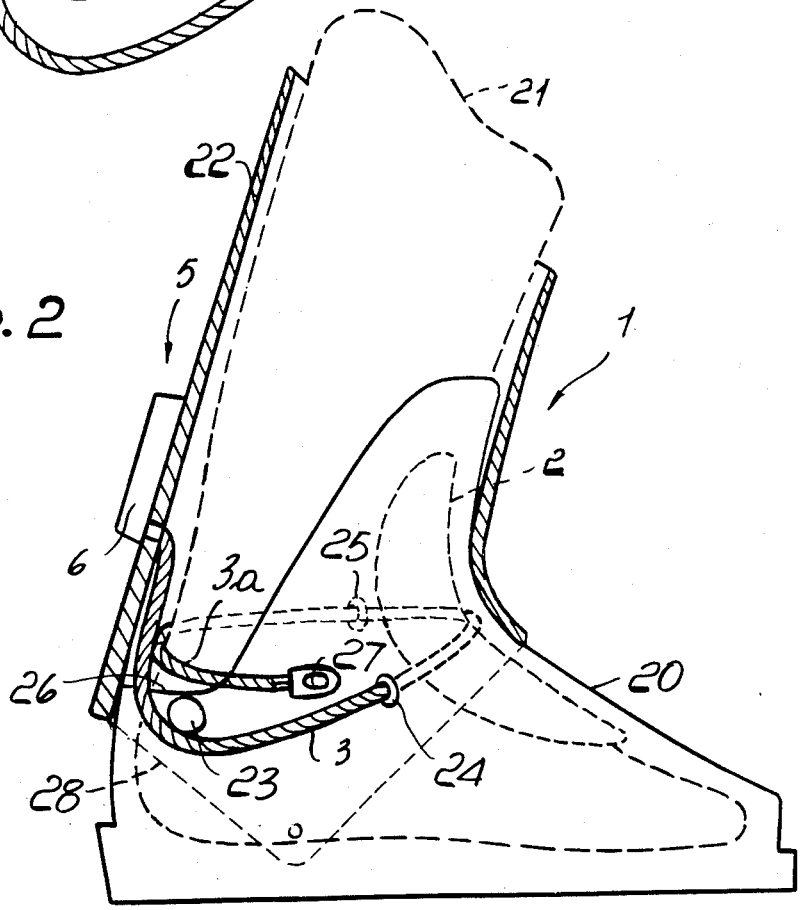
FIG. 2 is a part-sectional view of a ski boot incorporating this securing device.

The mentioned cable 3 coming from the reel 5 has a first terminal section 3*b* which extends between the quarter 22 and the shell 20, and is lead downwards by means of guide elements 23, which may comprise a pulley wheel, a guide pin or similar, advantageously supported on the shell 20. In the embodiment shown in FIG. 2, the element 23 is a guiding pin having a smooth peripheral surface, with which the cable slidably engages.

A second intermediate section 3*c* of the cable 3, which is slideable on the shell, is then slidably introduced through a first hole 24 on a side portion 20*c* of the shell 20, to the interior of the shell, wherein it is diverted transversally and upwardly with its first intermediate section 3*d* over the presser 2; the cable then exits to the outside of the shell 20 with a third intermediate section 3*f* thereof through a second hole 25 provided laterally on the shell at an opposite side portion 20*d* with respect to that 20*c* bearing the first hole 24. The holes 24 and 25 are covered by the flap portions 28 of the quarter 22 and shown in dotted lines in FIG. 2, so that said section of the cable 3 is slidable between the shell and quarter portions.

The cable 3 then first extends outside of the shell with the third intermediate section 3*f* thereof, which is covered by the quarter flaps, to embrace afterwards with a second terminal section 3*a* thereof the heel region of the soft inner boot 21, in correspondence with a rear cutout 26 of the shell, and is finally connected at a fixed anchoring point 27, preferably located on the lateral surface of the shell 20 at an opposite portion with respect to that bearing the second hole 25.

The fixed point 27 on the ski boot is at an area which would advantageously be located sideways to the presser and below it.

With the arrangement just described, on taking the cable up on the reel 5, a compressive action is developed on the foot through the soft inner boot or liner, as shown schematically in FIG. 1, which results in the presser being lowered to press the relevant inner boot portion or liner onto the foot instep and is accompanied by a thrust action applied by the cable to the heel through the relevant inner boot portion facing the heel, thereby the foot becomes clamped between two opposing areas. This affords an accurate and effective securement of the foot.

Furthermore, the arrangement described above prevents local concentrated pressures on the foot which could be inconvenient to the user. It would be possible to optionally provide at the heel region some pressure spreaders in the forms of plates or the like directed to increase the area of contact with the user's heel.

It should be added to the foregoing that at the heel region, the cable 3 may be engaged with a slot or eye 10 connected to the rear quarter and having the function of facilitating slackening of the cable as the boot is being opened i.e. when the rear quarter is swung rearwardly, so that the foot can be slipped in and out of the boot more easily.

The use of the device just described is quite simple. In fact, the user is only required to act on the knob 6 to take up cable on the reel 5, thereby by changing the working length of the cable itself, it will tend to develop a compressive action at the presser and a thrust action at the heel, thus "clamping" the foot and holding it firmly in position.

Once a desired locking condition has been achieved exerting the right pressure, on releasing the knob 6 one can be assured of the same remaining securely in its set position.

For releasing, the knob is simply turned in the opposite direction to quickly pay out cable 2 from the reel and hence remove the pressure exerted by the presser element 1 and the thrust exerted on the heel region.

It may be appreciated from the foregoing that the invention achieves its objects, and in particular that through the provision of a cable which virtually encloses the foot at the instep and heel regions, the foot can be stably and reliably secured within the ski boot onto the shell 20 thereof in at least three mutually spaced apart points defined by the holes 24 and 25 and the anchoring point 27.

In practicing the invention, the materials used, so long as they are compatible with the intended application, and the dimensions and shapes may be any ones contingent on individual requirements.

I claim:

1. In a ski boot having a shell with an instep zone defining instep portion and an inside heel zone defining heel portion opposite said instep portion and opposite side portions connecting said instep portion with said heel portion and with a presser element in the zone of and below said instep portion and adapted to receive therein a user's foot with liner means thereon, a foot securing device comprising first opening defining means in one of said opposite side portions at a distance from said heel portion, second opening defining means in another of said opposite side portions at a distance from said heel portion, cable tensioning means on said ski boot and cable anchoring means on said shell portion, cable means including a first intermediate section thereof extending between said first and said second opening defining means overriding said presser element below said instep portion and slidably passing through said first and said second opening defining means, said cable means having a second intermediate section extending from said first intermediate section beyond said first opening defining means towards said heel portion, said cable means having moreover a first terminal section extending from said second intermediate section at said heel portion up to said cable tensioning means and in operative engagement therewith, said cable means having further a third intermediate section extending from said first intermediate section thereof beyond said second opening means towards said heel portion and a second terminal section extending from said third intermediate section around said inside heel zone and inwardly along at least part of said one side portion of said shell up to said cable anchoring means, thereby to cause said cable means to form inwardly of said instep portion, said heel portion and said opposite side portions a loop formation surrounding with at least partially overlapping loop portions said user's foot with said liner means arranged at least between said cable means and the user's foot when the user's foot is received therein and to exert a securing action of said user's foot onto said shell at at least three spaced apart points when said tensioning means are actuated to tension said cable means and seucre said user's foot in cooperation with said first and second opening defining means and said anchoring means.

2. A device according to claim 1, further comprising guiding means on the inside of said one side portion of said shell between said heel portion and said first opening means to guide said cable means at a transition zone between said second intermediate portion and said first terminal portion thereof.

3. A device according to claim 1, wherein said liner means are in the form of an inner boot of soft material.

4. In a ski boot having a shell with an instep zone defining instep portion and an inside heel zone defining heel portion opposite said instep portion and opposite side portions connecting said instep portion with said heel portion and with a presser element in the zone of and below said instep portion and adapted to receive therein an inner boot, a foot securing device comprising first opening defining means in one of said opposite side portions at a distance from said heel portion, second opening defining means in another of said opposite side portions at a distance from said heel portion, cable tensioning means near said heel portion and cable anchoring means on said shell portion, cable means including a first intermediate section thereof extending between said first and said second opening defining means overriding said presser element below said instep portion and slidably passing through said first and said second opening defining means, said cable means having a second intermediate section extending from said first intermediate section beyond said first opening defining means towards said heel portion, said cable means having moreover a first terminal section extending from said second intermediate section at said heel portion up to said cable tensioning means and in operative engagement therewith, said cable means having further a third intermediate section extending from said first intermedite section thereof beyond said second opening means towards said heel portion and a second terminal section extending from said third intermediate section around said inside heel zone and inwardly along at least part of said one side portion of said shell up to said cable anchoring means, guiding means on the inside of said one side portion of said shell between said heel portion and said first opening means to guide said cable means at a transition zone between said second intermediate portion and said first terminal portion thereof, thereby to cause said cable means to form inwardly of said instep portion, said heel portion and said opposite side portions a loop formation surrounding with at least partially overlapping loop portions said inner boot and the user's foot when the user's foot is received therein and to exert a securing action of said inner boot onto said shell at at least three spaced apart points when said tensioning means are actuated to tension said cable means and secure said inner boot inwardly onto said shell in cooperation with said first and second opening defining means, said guiding means and said anchoring means.

5. A device according to claim 4, wherein said ski boot has at least one quarter member attached to and partially overlapping said shell and wherein said shell has a cutout at the heel portion thereof and wherein said third intermediate section of said cable means and said second terminal portion thereof extend at least in part over said cutout and wherein said quarter member has a flap portion thereof covering said third intermediate section and said second terminal and said second intermediate section and said first terminal section of said cable means.

6. A device according to claim 5, wherein said quarter member is a swingable rear quarter having an eye member connected thereto, said eye member being further connected to said cable means to facilitate slackening of said cable means when said rear quarter is rearwardly swung.

7. In a ski boot including a shell with an instep zone defining instep portion and an inside heel zone defining heel portion opposite said instep portion and having a cutout formed therein and opposite side portions connecting said instep portion with said heel portion and with a presser element in the zone of and below said instep portion and adapted to receive therein an inner boot and further including a rear quarter swingably connected thereto, said rear quarter having flap formations covering said cutout and overlapping at least a portion of said shell, a foot securing device comprising first opening defining means in one of said opposite side portions at a distance from said heel portion, second opening defining means in another of said opposite side portions at a distance from said heel portion, cable tensioning means on said rear quarter and cable anchoring means on said shell portion, cable means including a first intermediate section thereof extending between said first and said second opening defining means overriding said presser element below said instep portion and slidably passing through said first and said second opening defining means, said cable means having a second intermediate section extending from said first intermediate section beyond said first opening defining means towards said heel portion, said cable means having moreover a first terminal section extending from said second intermediate section at said heel portion up to said cable tensioning means and in operative engagement therewith, said cable means having further a third intermediate section extending from said first intermediate section thereof beyond said second opening means towards said heel portion and in part over said cutout, and a second terminal section extending from said third intermediate section around said inside heel zone and inwardly over said cutout and along at least part of said one side portion of said shell up to said cable anchoring means, guiding means on the inside of said one side portion of said shell between said heel portion and said first opening means to guide said cable means at a transition zone between said second intermediate portion and said first terminal portion thereof, said flap formations of said rear quarter overlapping a portion of said shell and thereby covering said second intermediate section, said third intermediate section and said first and said second terminal sections of said cable means, thereby to cause said cable means to form inwardly of said instep portion, said heel portion and said opposite side portions a loop formation surrounding with at least partially overlapping loop portions said inner boot and the user's foot when the user's foot is received therein and to exert a securing action of said inner boot onto said shell at at least three spaced apart points when said tensioning means are actuated to tension said cable means and secure said inner boot inwardly onto said shell in cooperation with said first and second opening defining means, said guiding means and said anchoring means.

* * * * *